United States Patent [19]

Wilson et al.

[11] Patent Number: 4,722,284

[45] Date of Patent: Feb. 2, 1988

[54] DISPLAY RACK

[76] Inventors: Jewell E. Wilson, 1409 S. 15th Ave., Yakima, Wash. 98908; John P. Hodkinson, Jr., 3710 2nd St.; A. L. Molineux, 3802 S. 3rd St., both of Union Gap, all of Wash. 98903

[21] Appl. No.: 904,602

[22] Filed: Sep. 8, 1986

[51] Int. Cl.[4] ..... A47B 9/00

[52] U.S. Cl. ..... 108/108; 211/163

[58] Field of Search ..... 108/106, 107, 108, 109, 108/111, 114, 95; 211/149, 163, 186, 187, 150; 312/285

[56] References Cited

U.S. PATENT DOCUMENTS

| | | | |
|---|---|---|---|
| 320,566 | 6/1885 | Leonard | 312/285 X |
| 3,502,226 | 3/1970 | Marschak | 211/163 |
| 3,538,863 | 11/1970 | Howard et al. | 108/114 X |
| 3,685,664 | 8/1972 | Kramer | 108/111 X |
| 3,756,422 | 9/1973 | Ostring | 211/163 |
| 3,865,249 | 2/1975 | Herzog | 211/163 |
| 3,942,647 | 3/1976 | Crosslen | 211/163 X |
| 4,312,086 | 1/1982 | Bianco | 108/108 X |
| 4,415,090 | 11/1983 | Bustos | 211/150 X |

FOREIGN PATENT DOCUMENTS

| | | | |
|---|---|---|---|
| 670437 | 3/1937 | Fed. Rep. of Germany | 312/285 |

*Primary Examiner*—Peter A. Aschenbrenner
*Attorney, Agent, or Firm*—Dowrey, Cross & Cole

[57] ABSTRACT

A free standing display rack having top and bottom panels with a central support core with offset core walls extending from the core corners to the periphery of the top and bottom panels. The core panels and their vertical side wall support posts provide vertically adjustable support means for the individual shelves about the complete periphery of the rack.

3 Claims, 5 Drawing Figures

DISPLAY RACK

BACKGROUND OF THE INVENTION

1. Field of the Invention

This invention relates to a free standing display rack having vertically spaced shelves for use in such environments as supermarkets, department stores and especially in convenience markets or other point-of-purchase environments. More particularly, the present invention relates to the structural configuration of such display rack which enables a more efficient use of floor space by the provision of maximum lineal footage of shelving while providing ease of accessibility and minimum line-of-sight obstruction for security purposes.

2. Description of the Related Art

With the increased emphasis on retail merchandising in recent years, many sophisticated display rack structures and configurations have evolved for both special and generalized use. Many of these structures or systems, such as those disclosed in I. W. Shell, U.S. Pat. No. 3,085,693 and Sobel U.S. Pat. No. 3,877,395, constitute a very complex array of specially manufactured inter-fitting parts which may be joined together to form the shelves and support structure. These systems are characterized by metal struts, posts and brackets which are generally expensive to manufacture and difficult to repair and sometimes impossible to replace. If the load to be carried by the shelving unit is of any size, these structures become heavy and cumbersome. The usual configuration of this type of rack or self standing unit is that of central upstanding posts, such as shown in the patents mentioned above and in the U.S. patent to Schick U.S. Pat. No. 2,540,353. As typified by these patents, an effort is made to completely support a shelf about the periphery of a central post or group of spaced posts by cantilever support arms. As with the patents mentioned above and as also illustrated by the U.S. patent to Skrzelowski U.S. Pat. No. 3,908,830, the tendancy has been toward an elongated and sometimes above-eye-level configuration of shelving unit sometimes known as gondola shelving. These units are then arranged so as to form elongated aisles in supermarkets and the like.

Another example of display rack structure illustrating the use of metal posts and brackets is the U.S. patent to Thauer U.S. Pat. No. No. 4,299,327 wherein central support posts are utilized to provide a stand from which wire racks are hung.

SUMMARY OF THE INVENTION

The present invention provides a durable free standing display rack which is sufficiently rigid to support heavy items for retail sales such as canned goods, etc. The unit is constructed from inexpensive and generally available materials such as wood or plastic with a minimum of metal parts and which requires no special tools to manufacture or maintain. The unit is characterized as having a central floor supported core with shelves extending completely around its perimeter. The individual shelves are easily rearranged for different vertical positioning and are provided with the maximum support from strategically located upright support posts associated with the core panels. The arrangement of shelving provides the maximum lineal footage for the floor space occupied and may be dimensioned so as to obtain increased visibility about the shelves to aid in security in such environments as late night convenience stores or in situations of limited space and heavy customer traffic. the unit may be utilized to replace view obstructing gondolatype shelving units so as to provide equal or better lineal shelf space while improving visibility for security reasons.

DESCRIPTION OF THE PREFERRED EMBODIMENT

Figure 1:
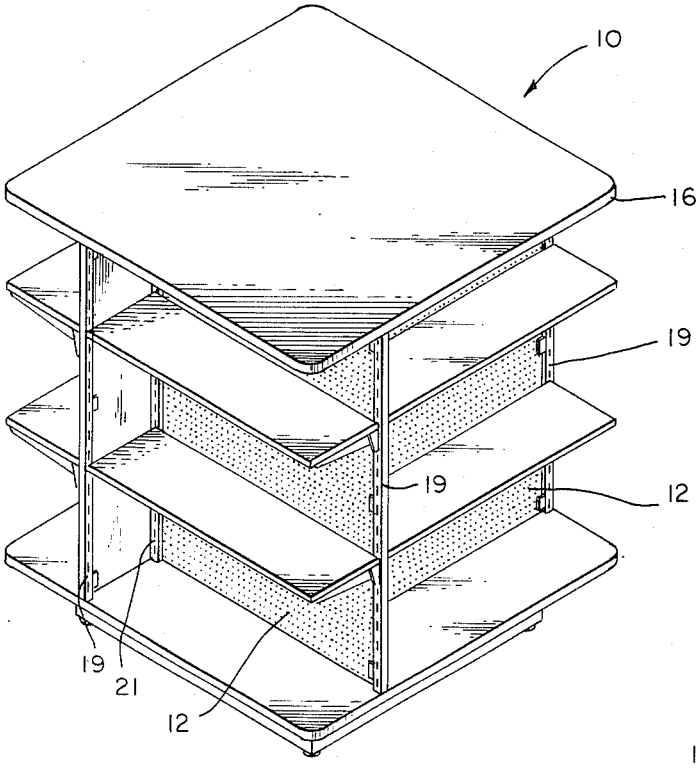
FIG. 1 is a perspective view of the display rack of the present invention.
Figure 2:
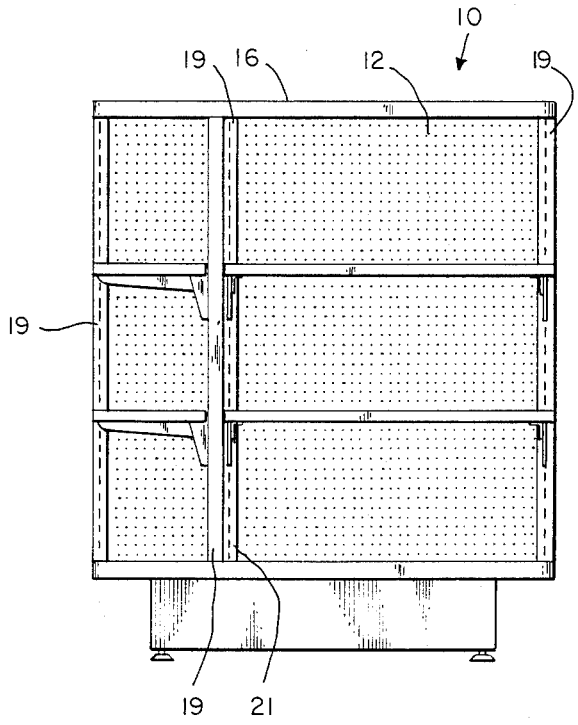
FIG. 2 is a side elevational view of the display rack of FIG. 1.

Referring to FIG. 1, the display rack of the present embodiment of the invention includes a flat planar top panel 10, a planar bottom panel 11, four identical core walls 12, identical shelves 13, and the support pedestal 14 indicated in FIG. 2. The top panel 10 may be identical to the bottom panel 11 for simplicity and may be constructed from plywood, particle board or the like with a hard surface covering such as a high pressure laminate if desired. the peripheral edges 15 and 16 of the top and bottom panels 10 and 11 may also be provided with an adhesively applied plastic stripping or the like if desired.

One example of a display rack has been constructed according to the invention utilizing four foot square top and bottom panels 10 and 11 with an overall rack height of approximately 4½ feet. This size of unit is found to be ideal for convenience store use.

Figure 3:
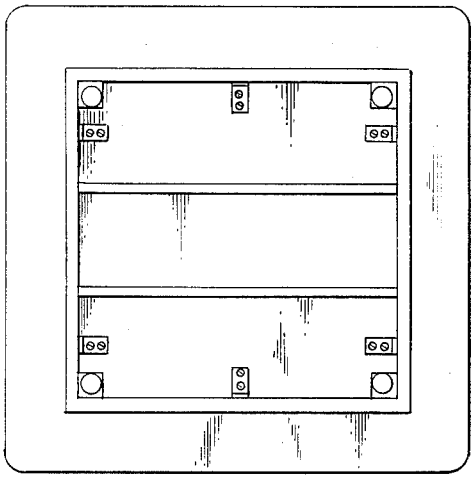
FIG. 3 is a bottom plan view of the display rack of FIG. 1.
Figure 4:
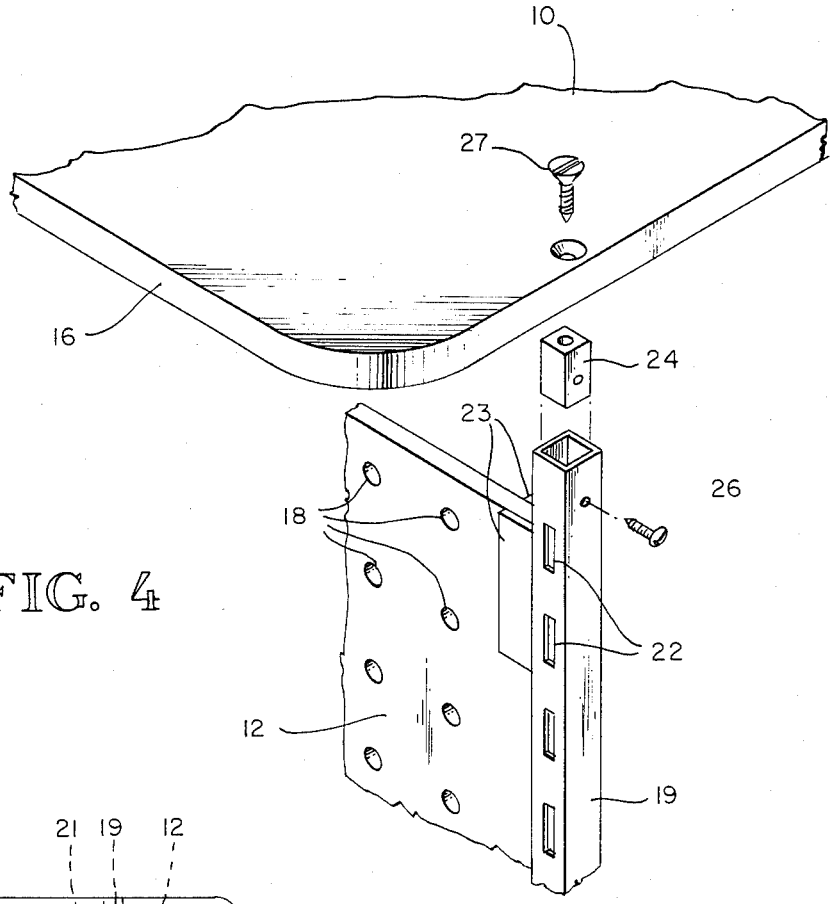
FIG. 4 is an exploded view showing the details of the manner in which vertical support posts are connected to the planar top and bottom panels and the core side walls of the rack.
Figure 5:
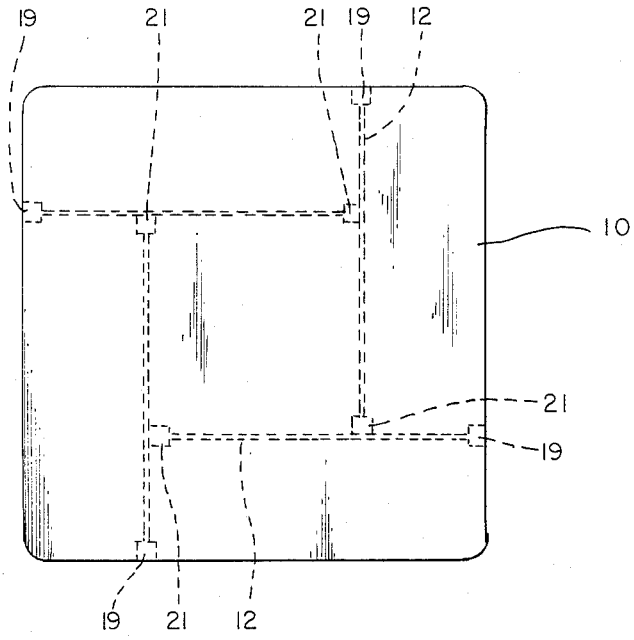
FIG. 5 is a top plan view of the display rack.

The vertical core panels 12, as mentioned may be identical and extend between the top and bottom panels 10 and 11 so as to form a rectangular hollow core as illustrated in FIG. 5. Each panel 12 extends from the rectangular core outwardly to the peripheral edge of the top and bottom panels 10 and 11. This configuration provides for four identical shelf members 13 which extend around the complete periphery of the central core. The core panels 12 may be constructed of a fiber press board or the like such as a commonly known pegboard material which includes uniformly spaced holes 18 for attachment purposes in a well known manner. The core panels 12 are attached to the top side of the bottom panel 11 and the under side of the top panel 10 by means of the four peripheral posts 19 and the core corner posts 21. The posts 19 and 21 may be identical in detail and are interchangeable, reducing the requirement for multiple and diverse interfitting parts. Posts 19 and 21 are commercially available and comprise hollow metal tubes with vertically spaced rectangular holes 22, as illustrated in FIG. 4, for the reception of shelf brackets as will be presently described. The posts 19 and 21 will be provided with the channel brackets 23 at least at the top and bottom ends and at intermediate locations as required. The brackets 23 may be of any variety of available brackets and may be welded or bolted to the posts in any well known manner. The brackets 23 receive the vertical side edges of the core panels 12 as shown in FIG. 4. The ends of the posts 19 and 21 are fitted with rectangular plugs or blocks 24 held therein by means of screw members or the like 26. The top and bottom panels 10 and 11 are then connected to the bottom and top ends of all of the posts 19 and 21 by means of the screw members 27 which extend through the panels and into the plugs 24 in the posts. Since the posts are interfitted with the four core panels 12 the structure becomes rigid when thus assembled. the entire rack is supported on the floor by means of the rectangular pedestal base 14 comprising a rectangular frame with suitable cross bracing as shown in FIG. 3. The base 14 is connected to the bottom side of the panel 11 by means of angle brackets or the like 28 in a conventional manner. If desired, the pedestal 14 may be provided with adjustable screw pads 29 of a conventional design for leveling.

As illustrated in FIGS. 1 and 2, each shelf 13 is supported at one end by means of the conventional bracket device 31 which engages and is supported in a slot 22 in one of the peripheral posts. The bracket and post system is well known in the art and may be of any commercially available variety. The patent to Shell U.S. Pat. No. 3,085,693 illustrates one commercially available embodiment of shelf bracket. The opposite end of each of the shelves 13 is provided with an identical shelf bracket which engages a corresponding core post 21. This is shown most clearly in FIG. 2. With this structural arrangement, each of the shelves is independently adjustable for elevation along its core and peripheral post supports.

Although a specific embodiment of core and peripheral bracket design has been illustrated, the present invention may be practiced utilizing any desired post and bracket or wall and bracket configuration available in the prior art. Other variations in the manner of connecting the various structural members described may also be practiced without departing from the spirit of the invention.

As will be understood from the foregoing description, a display rack of an extremely simplified construction is provided by the present invention wherein the principle structural components are all interchangeable and easy to assemble. The provision of peripheral shelving depending from offset core walls completely around the periphery of the core results in a maximum lineal footage of shelving for any particular unit. For instance in a four foot square rack it is possible to obtain twelve lineal feet of shelf. The offsetting of the core walls to extend from one corner of the core to the outer peripheral edge of the top and bottom panels provides the extra stability which makes the predominantly nonmetallic and unbolted structure dimensionally stable.

Although the present invention has been described with respect to a preferred embodiment, modifications to the disclosed embodiment or its use in a different setting is well within the scope of the invention.

What is claimed is:

1. A display rack comprising in combination;

a bottom horizontal substantially planar panel member, a top horizontal substantially planar panel member spaced vertically from said bottom panel member, a plurality of spaced upright core post members spaced equidistantly from the peripheral edge of said top and bottom panels, a plurality of spaced upright peripheral post members located adjacent the peripheral edges of said top and bottom panels, each said core and peripheral post members being connected to the top and bottom panel members at the opposite ends thereof, a plurality of core wall members, each said core wall members extending between a core post and one of said peripheral posts to define a closed rectangular core area located centrally of said top and bottom panel members, means maintaining said core wall members in vertical alignment with the associated core and peripheral post members in fixed lateral engagement therewith, pedestal means connected to the bottom face of said bottom panel, said pedestal means adapted to support said display rack in vertical spaced relation to a support surface, a plurality of shelf means, each said shelf means having one free longitudinal edge with the opposite longitudinal thereof located adjacent an associated core wall member, and one free end edge with the opposite end edge thereof adjacent another one of said core wall members, and support bracket means connected to each associated core and peripheral post members, said support bracket means being constructed and arranged to vertically adjustably support one of said shelf means, each said core wall members including an end portion extending beyond said core area to the peripheral edges of said top and bottom panels and located adjacent one end of the associated shelves carried by an adjacent core wall, whereby said core area is formed inwardly and centrally of said peripheral edges and said shelf means extends along substantially the entire peripheral edges of said top and bottom panel members.

2. The display rack of claim 1 wherein said core wall members include uniformly spaced perforations for attachment of display items.

3. The display rack of claim 1 wherein the cross section of said closed core area and the outline of said top and bottom panels are square, said shelf means being equal in length.

* * * * *

UNITED STATES PATENT AND TRADEMARK OFFICE

CERTIFICATE OF CORRECTION

PATENT NO. : 4,722,284

DATED : Feb. 2, 1988

INVENTOR(S) : Jewell E. Wilson, et al

It is certified that error appears in the above-identified patent and that said Letters Patent are hereby corrected as shown below:

Column 4, line 30, insert --edge-- after "longitudinal"

Signed and Sealed this

Twelfth Day of July, 1988

*Attest:*

*Attesting Officer*

DONALD J. QUIGG

*Commissioner of Patents and Trademarks*